US009534872B2

(12) United States Patent
Bain

(10) Patent No.: US 9,534,872 B2
(45) Date of Patent: Jan. 3, 2017

(54) NON-SCALAR FLEXIBLE RIFLE DEFEATING ARMOR SYSTEM

(71) Applicant: Allan Douglas Bain, Missouri City, TX (US)

(72) Inventor: Allan Douglas Bain, Missouri City, TX (US)

( * ) Notice: Subject to any disclaimer, the term of this patent is extended or adjusted under 35 U.S.C. 154(b) by 0 days.

(21) Appl. No.: 14/756,846

(22) Filed: Oct. 21, 2015

(65) Prior Publication Data

US 2016/0131457 A1 May 12, 2016

Related U.S. Application Data

(60) Provisional application No. 62/122,442, filed on Oct. 21, 2014.

(51) Int. Cl.
*F41H 5/02* (2006.01)
*F41H 5/04* (2006.01)

(52) U.S. Cl.
CPC ..... *F41H 5/0428* (2013.01); *F41H 5/0492* (2013.01)

(58) Field of Classification Search
CPC ..... F41H 5/0428; F41H 5/0492
USPC ..... 89/36.01–36.05, 36.07, 908
See application file for complete search history.

(56) References Cited

U.S. PATENT DOCUMENTS 4,683,800 A * 8/1987 Snedeker ..... F41H 5/04 428/911
5,170,690 A * 12/1992 Smirlock ..... F41H 5/013 89/36.02
5,333,532 A * 8/1994 Smirlock ..... F41H 5/013 109/49.5
5,349,893 A * 9/1994 Dunn ..... F41H 5/04 2/2.5
5,705,764 A * 1/1998 Schade ..... F41H 5/0428 428/911
5,996,115 A * 12/1999 Mazelsky ..... F41H 1/02 2/2.5
6,532,857 B1 * 3/2003 Shih ..... F41H 5/0421 89/36.02
7,874,239 B2 * 1/2011 Howland ..... F41H 1/02 2/2.5
8,424,442 B2 * 4/2013 Ward ..... F41H 5/0414 52/385
8,490,213 B2 * 7/2013 Neal ..... A41D 31/005 2/2.5
2010/0031810 A1 * 2/2010 Neal ..... F41H 5/0407 89/36.02

(Continued)

*Primary Examiner* — Samir Abdosh
(74) *Attorney, Agent, or Firm* — Eggink & Eggink

(57) ABSTRACT

The invention combines tiles with an optimal width to thickness ratio together into array(s), and then affixes the array(s) to a depressible adhesive coated substrate. This combination of array(s) and substrates compliments the optimal tile thickness to width ratio to create a more advantageous directional shift of energy dissipation that creates a yaw of the bullet's direction, and subsequent increase of ceramic thickness that the projectile must pass through. The invention eliminates hard epoxies and rigid fiber induced wraps to create a truly flexible matrix that can be applied for use to protect the body with traditional concealable or tactical carriers, or can be used as a "peel and stick" high threat armor system that can be easily field mounted to a vehicle, structure, or aircraft.

20 Claims, 8 Drawing Sheets

(56) References Cited

U.S. PATENT DOCUMENTS

| | | | | |
|---|---|---|---|---|
| 2011/0023697 | A1* | 2/2011 | Howland | F41H 5/0428 89/36.02 |
| 2011/0203452 | A1* | 8/2011 | Kucherov | B32B 17/10119 89/36.02 |
| 2011/0239851 | A1* | 10/2011 | Mason | B32B 27/04 89/36.02 |
| 2012/0174754 | A1* | 7/2012 | Salisbury | B32B 9/005 89/36.02 |
| 2012/0174759 | A1* | 7/2012 | Gallo | F41A 17/06 89/36.02 |
| 2012/0186426 | A1* | 7/2012 | Ward | F41H 5/0492 89/36.02 |
| 2012/0240758 | A1* | 9/2012 | Cohen | F41H 5/0492 89/36.02 |
| 2014/0230638 | A1* | 8/2014 | Waldrop | F41H 5/0428 89/36.02 |
| 2014/0366713 | A1* | 12/2014 | Howland | F41H 5/0428 89/36.02 |

* cited by examiner

NON-SCALAR FLEXIBLE RIFLE DEFEATING ARMOR SYSTEM

This Non-Provisional application claims the benefit of U.S. Provisional Application No. 62/122,442 filed on Oct. 22, 2014.

The following is a description of exampled embodiments, which is further described by the included drawings. The embodiments are examples, and are in such detail for clear communication of the specification. However, the amount of detail offered is not intended to limit the anticipated variations of embodiments; on the contrary, the intention is to cover all modifications, equivalents, and alternatives falling within the spirit and scope of the present disclosures. The descriptions and drawings below are designed to make such embodiments obvious to a person of ordinary skill in the art.

BACKGROUND

Early in the 1990's the evolution of scalar type armor was reinvented using 1" diameter 0.032 thick titanium alloy discs in an imbricated pattern applied to an adhesive coated high strength fabric substrate(s). This eliminated rivets, wires, or sewn envelops as was the method of affixing tiles or coins in a scalar armor format using the prior art. Further evolution of this method involved using larger high toughness metallic or high hardness ceramic 2" diameter disks formed into a discus shape to limit weight and thickness of the redundant overlaps inherent in scalar armor. The problem however with scalar rifle resistant armor systems has always been the excessive thickness and weight caused by the redundant two and three tile overlaps present over the entire system. These overlapped areas when flexed caused weak areas of the system, and a weight penalty that is no longer competitive in the current art of today's modern ballistic armor systems. Thus there is a need to reduce the weight and thickness while improving flexibility of an armor system meant to defeat rifle rounds in the modern era of armor meant for body protection, vehicles, aircraft, and structures.

DETAILED DESCRIPTION OF THE INVENTION

Figure 1A:
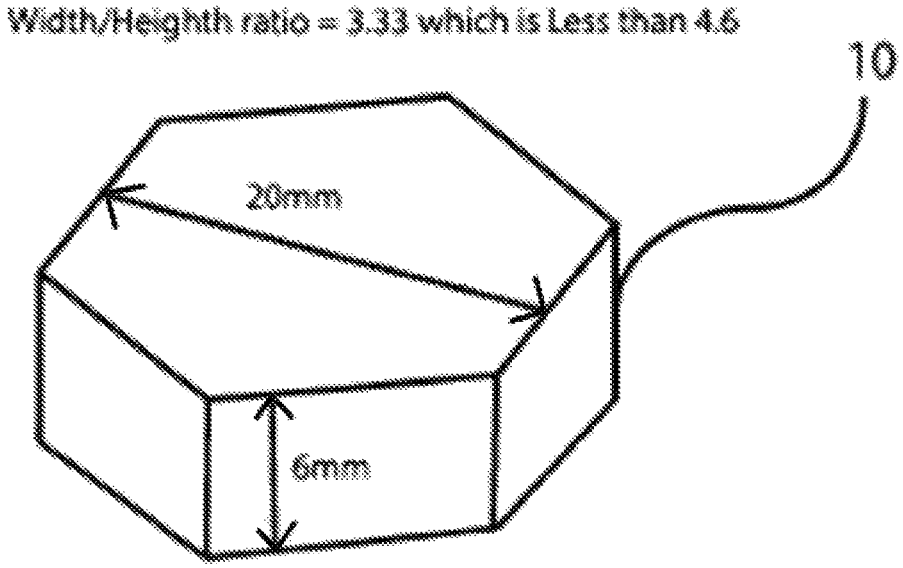
FIG. 1*a* is a perspective view of a tile component used in the flexible tile array of the flexible armor assembly of the invention.
Figure 2A:
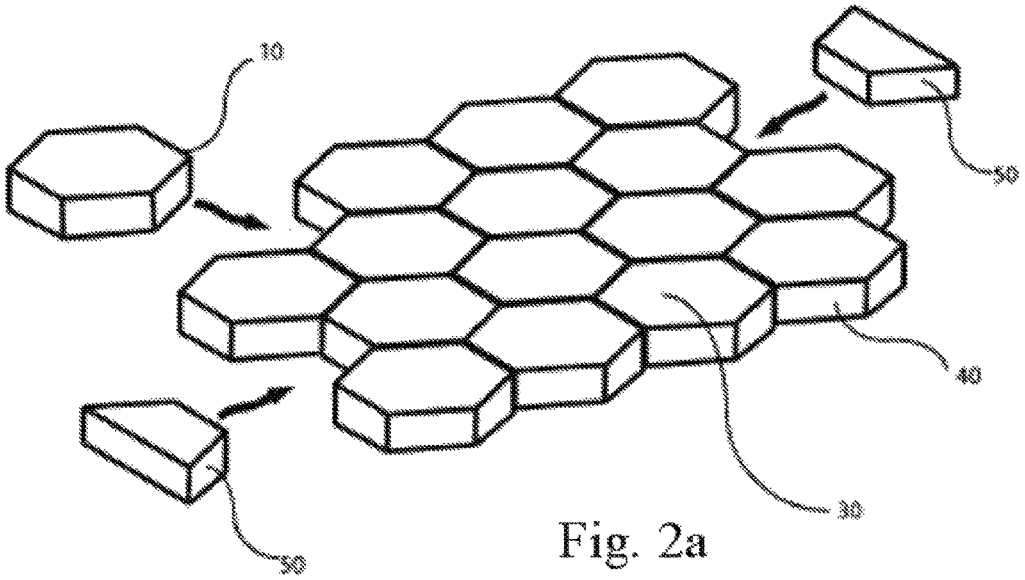
FIG. 2*a* is a top perspective view showing a tile array for the flexible armor assembly of the invention.
Figure 2B:
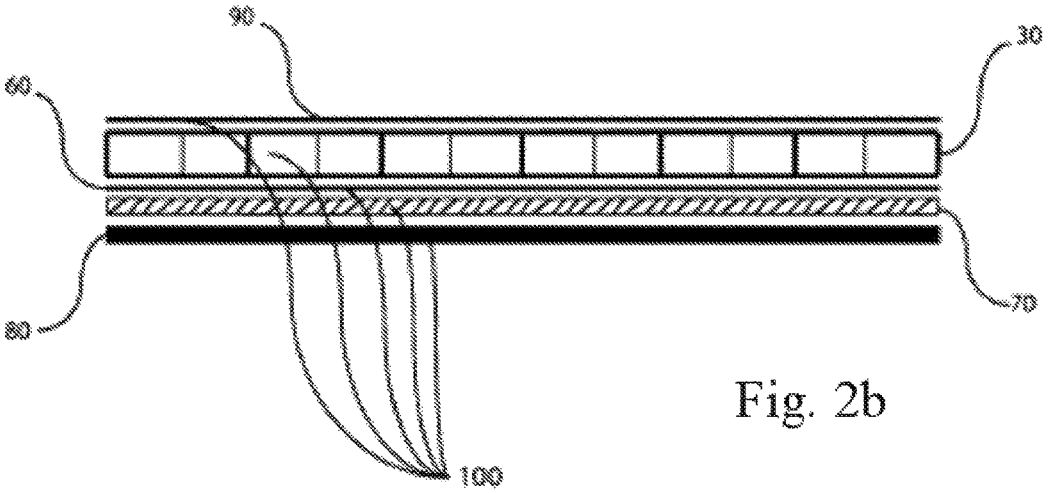
FIG. 2*b* is a lateral view showing the flexible armor assembly.

FIG. 1*a* depicts a shape and configuration of a high hardness and/or high toughness material that comprises the component used as the strike face of the armor system, and is designed to blunt and/or tear apart the bullet for the remainder of the system to catch the resulting fragmentation. FIG. 2*b* depicts another shape and configuration of a component tile. In typical rigid uniform planular hard plates or scalar armor meant for defeat of rifle projectiles the strike face material is typically comprised of ceramic, and is usually a large tile or monolith; even mosaic tile systems are usually at least 1" in diameter representing a large width to thickness ratio. In these described typical embodiments of the prior art, the high hardness and/or tough material(s) are usually laminated to a rigid textile substrate to restrict the movement of the strike face components so as to prevent the material from flying apart too quickly during the ballistic event. The energy dispersal pattern with these large width tiles is described as expending and propagating energy horizontally from the bullets impact location, and this phenomenon is referred to as shock wave propagation. The invention herein called Non-Scalar Flexible Rifle Defeating Armor uses a different shape component, such that the thickness is closer in proportion to the width of said component, which can be comprised of a high hardness ceramic materials, cermet's, nanomaterials, metals, or really any material that has mechanical properties high in hardness, tensile and/or modulus strength.

Figure 1B:
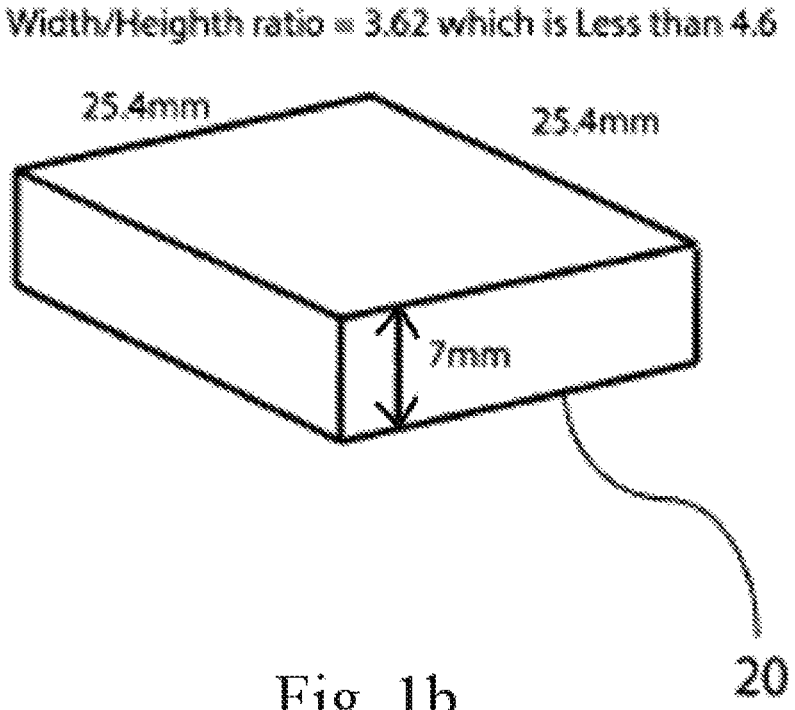
FIG. 1*b* is a perspective view of another tile component used in the invention.
Figure 2C:
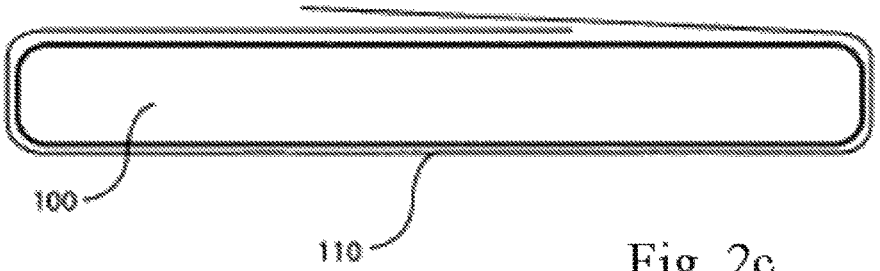
FIG. 2*c* is a lateral view showing a retaining strap around the assembly.

For the purposes of describing this embodiment the component is comprised of silicon carbide as an example. When the shape of the strike face component has a ratio whereby the thickness is closer in proportion to the width the directional shock wave forces tend to move along with the directional path of the projectile through the component tile material, and thus causes less collateral damage and thereby increases repeat hit capability. In testing to the NIJ 0101.03 standard a complete flexible panel inclusive of all the substrates and arrays as shown in FIGS. 2*a*-2*c* was able to defeat 11 M-80 FMJ projectiles in a row on a small 10×12 flex panel. After the post mortem was conducted on the shot panel it was obvious that there was significant room for more shots which is something not achievable with a rigid ceramic textile composite representative of the prior art. The typical ceramic tile used for a rigid armor plate is a 50.8 mm wide square for mosaic designs and the thickness is anywhere from 4.2 mm-5 mm for NIJ threat level 3, and 50.8 mm wide and 9 mm-11 mm thick for NIJ threat level 4. The ratios created are greater than 4.6:1, whereas in the instant invention the ratio of component tile 10 is less than 4.6:1 ratio between the thickness of the component tile and the width of the same tile. In FIGS. 1*a* and 1*b* respectively, tile 10 and tile 20 illustrate ratios of less than 4.6:1, and this ratio can be further reduced as it is economically viable. Additionally the typical high hardness material like silicon carbide that many rifle resistant systems are comprised of have a method of containing the ceramic tile using a fiber and epoxy induced wrap in order to prevent the ceramic from flying apart on impact maximizing the time the ceramic is involved in the ballistic event in order to create the most damage to the projectile. Tile 10 and tile 20 in FIGS. 1*a* and 1*b* requires no epoxy and fiber induced wrapping to achieve maximum performance of the strike face component, and can be affixed to a high temperature resistant, high peel strength adhesive coated high tensile strength fabric material as described with respect to FIGS. 2*a*-2*c*, thus eliminating expensive and time consuming autoclave and epoxy prepreg layups. Tile 10 and 20 are shown in FIGS. 1*a* and 1*b* as a hexagon and square respectively, but any shape that can butt up to a contiguous or adjacent side of a another identical tile and expose no foraminous areas of the array(s) are suitable, for example, a triangular tile is within the spirit and scope of the invention as the shape for the strike face component including partial shaped finish pieces.

FIG. 2*a* depicts an angled top view of the strike face component tile 10 along with other identical strike face components fitted butt to butt with each other to create a tile array 30 as shown in FIG. 2*b*. Additionally, we view the tile array from the side view depicting the thickness of the strike face component 40. The tile array 30 is achieved by placing the strike face components tile 10 butt to butt including finish pieces 50 to complete the desired final shape of the armor panel, and is adhered to with at least 1 mil thick adhesive coated high tenacity substrate material 60 comprised of at least 1 layers of high strength woven or UD aramid fabric, although any high strength fabric can be used for this purpose. The next substrate 70 is a depressible medium that has a shock absorbing effect, and is designed to allow tile component 10 independent movements within the tile array 30 with respect to the path of the bullet's impact direction. This causes energy dissipation through the tile as the bullet impacts the tile components 10 enabling a longer amount of time the bullet is in contact with the high hardness and/or high toughness strike face component 10. This effectively also causes a yaw of the bullet's direction at impact as components 10 although fitted butt to butt with other identical tiles tend to move independently of other tiles when impacted by a projectile. The next pack of high strength textile material 80 is usually comprised of UD polyethylene, but can use any high strength fabric. This is the area where the bullet fragments are caught after passing through the high hardness facing material 30 and depressible substrate 70. The final substrate is a surface protector 90 to preserve the integrity of the strike face component 10 and the surface array 30 from damage due to dropping the plate or from low velocity objects impacting the surface. As shown in FIG. 2*c*, a method of completing armor array 100 at least one retaining strap 110 is used, which is comprised of the same adhesive coated high strength fabric 60, and wraps around any side of the armor panel to couple substrates 30, 60, 70, 80, and 90 together. This coupled armor panel array 100 is then housed in a water proof nylon bag ready for use. Depending on how much high tenacity textile layers in pack 80 is used determines whether this finished armor panel array 100 is an "in conjunction with" flexible armor panel or a "stand alone" flexible armor panel. If it is layered to be a "in conjunction with" armor panel then it will have to be fitted in front of a NIJ 0101.06 Level 3-A soft armor panel to function.

In summary, the component tiles 10 and 20 are utilized to form tile arrays, i.e., tile array 30. The tiles may be formed of a ceramic material such as silicon carbide, boron carbide, nano-composites, a ferrous metal alloy or a non-ferrous metal alloy. The depressible shock absorbing substrate 70 may be formed of at least one layer of high density foam having a thickness of at least mm, at least one layer of a shear thickening polymer of at least 1 mm in thickness, or a thermal plastic polyurethane having a honeycomb pattern and a thickness of at least 3 mm. The high strength textile fragmentation catch may be formed of UHMW polyethylene cross plied unidirectional flexible laminates, a combination of aramid fabric and UHIMW polyethylene cross plied unidirectional flexible laminates or a combination of pressed and cured silicon resin impregnated aramid fabrics.

Figure 3A:
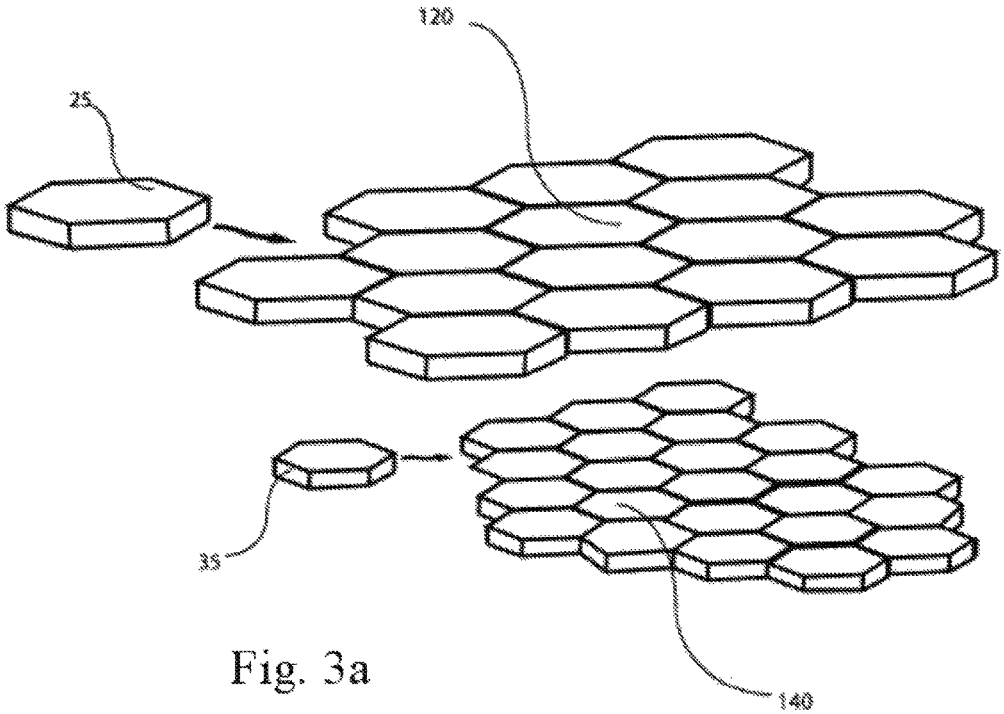
FIG. 3*a* is a perspective view of a two layer tile array for another embodiment of the flexible armor assembly of the invention.
Figure 3B:
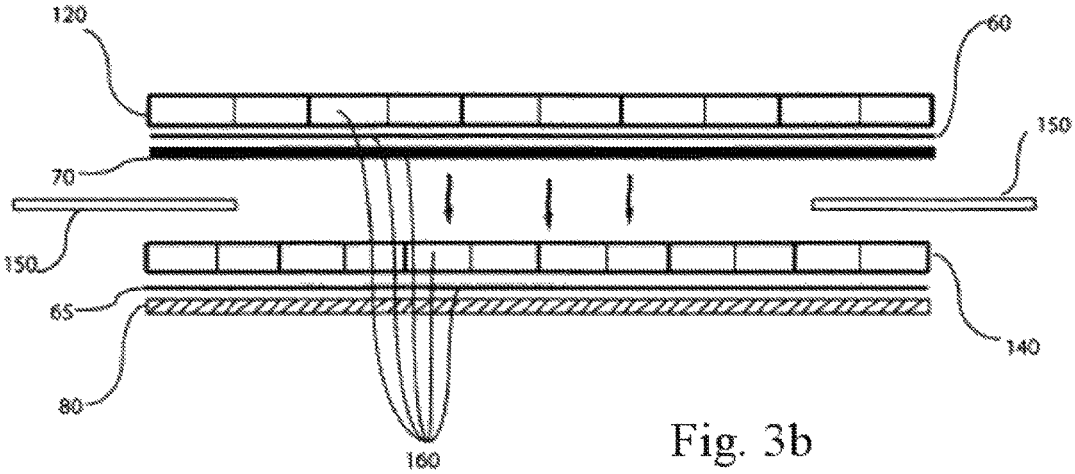
FIG. 3*b* is a lateral view showing another embodiment of the flexible armor assembly.

FIGS. 3*a*-3*b* depict alternative embodiments comprised of two different sizes of the original strike face component tile 25 having the width/thickness ratio greater than 4.6:1 and a second strike face component tile 35 with a width/thickness ratio of less than 4.6:1. Tiles 25 and 35 in the two layer array requires that the overall desired thickness is split into 2 or slightly greater so as not to be excessively heavy, therefore tiles 25 and 35 require a change in the width/thickness to maintain the desired ratio as stated above for this two layer array. The larger than 4.6:1 ratio strike face component tile 25 serves as the strike face of the two layer array, and tile 25 is again fitted with a number of other tile 25 components to create tile array 120. Then as before tile 25 is affixed to at least one adhesive coated high strength fabric substrate 60, and then to another substrate 70 comprised of a depressible spaced foam or other suitable shock absorbing spacer material of at least 1 mm in thickness. The second array layer utilizes the strike face component tile 35 which is less than the 4.6:1 width to thickness ratio along with other identical strike face components 35 fitted butt to butt with each other to create a tile array 140. Additionally, The tile array 140 is achieved by placing the strike face components tile 35 butt to butt to the desired final shape of the armor panel, and then adhered to an adhesive layer 65 usually comprised of at least 1 mil in thickness. The two arrays achieve a complimentary energy transfer by combining horizontal and vertical energy dissipation patterns by combining the energy dissipation tendencies of the two different width/thickness ratio tiles and their respective arrays. The ballistic event begins by the projectile impacting tile array 120 and at this instance the energy is dispersed horizontally from the impact location, while simultaneously blunting the projectile. The next tile array 140 being spaced on the other side of the depressible substrate 70 remains relatively unscathed, and therefore allows the second part of the ballistic event causing vertical energy dissipation in the strike face component 35 and a significant yaw of the bullet. This second tile array 140 energy dissipation is in a complimentary direction as compared to tile array 120. The tile array 140 simultaneously causes significant damage to the projectile and/or the projectile penetrative core. The two finished tile arrays 120 and 140 with the other cited substrates are stacked and then pressed with a silicon elastomer rubber adhesive to create the shape and final tile array 160 flexible armor panel, or can be used as loose tile arrays coupled by traditional attachment comprised of sewing, adhesive strips etc. and are then ready for placement in front of a suitable high strength package 80 comprised of aramid and/or UDPE, which flexibly catches any resulting fragmentation that pierces the tile arrays 160. Prior to pressing the two layers together as an option, "tabs" 150 comprised of high strength aramid fabric or other suitable materials can be placed in between the tile array 120 and 140 and the various substrates to be sandwiched permanently affixed during the pressing and curing process, and then used as a sewing medium to apply these resulting flexible coupled arrays to a soft armor backing 80 meant to catch fragmentation. Typically this textile fragment catch 80 would be considered an NIJ level 3-A panel, but it can be comprised of any textile configurations using a variety of materials to enhance fragmentation resistance, and is always placed behind the tile array(s) of any composition defined in the spirit and scope of this invention.

Figure 4A:
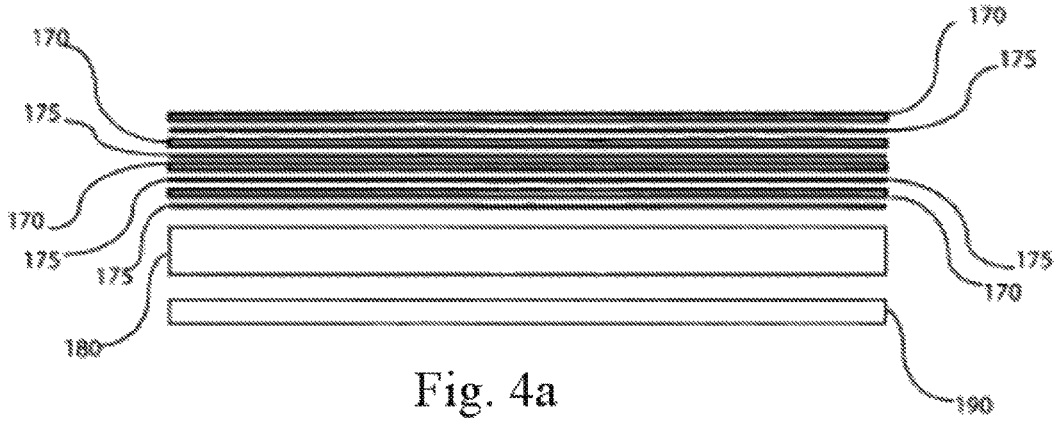
FIG. 4*a* is a lateral view showing another embodiment of the armor assembly of the invention.
Figure 4B:
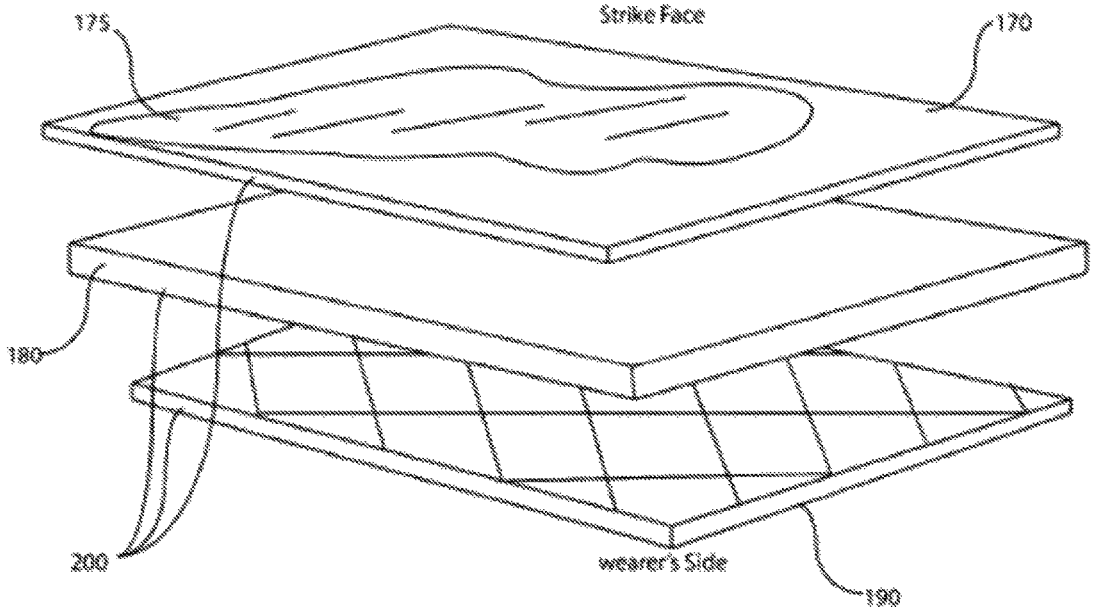
FIG. 4*b* is a perspective view further showing the embodiment of FIG. 4*a;*

FIGS. 4*a* and 4*b* illustrate an example of a high fragmentation resistant armor panel comprised of a variety of the most advanced high strength fabrics on the market. Depending on the application the combination can change, but in every exampled embodiment a high strength fabric meant for ballistics is used. In this example we have a side view, and side view of a square armor panel to illustrate the construction. The first pack 170 is comprised of a KEVLAR® 129-1420 denier fabric impregnated with a silicone elastomer rubber material 175 of at least 0.10 mm thickness and comprises 20% of the overall package; The second pack 180 is comprised of the latest generation UDPE flexible laminates comprising a 60% portion of the overall package. Finally the last pack 190 is comprised of KEVLAR® KM2+600 denier stitched in a diamond square pattern and no resin impregnation. All the packs 170, 175, 180, and 190 are combined together making pack 200. Pack 200 weighs at least 1 Lbs./Sq. Ft, but allows for a 20% increase in fragmentation and small arms (9 mm) ballistics, which exceeds military Mil Spec 662F specification for the current military offerings, and any and all addendums to this test specification. Typically this package would either have the aforementioned tile array packs tack stitched onto this textile soft armor package 200 described as integrated, or the textile soft armor package 200 would be housed in a protective NYLON® cover and the tile array packs would be used as a separate panels and considered "in conjunction with" to achieve the high threat flexible NIJ level 3 and/or 4 performance with the soft armor pack 200 behind aforementioned tile arrays packages.

Figure 5A:
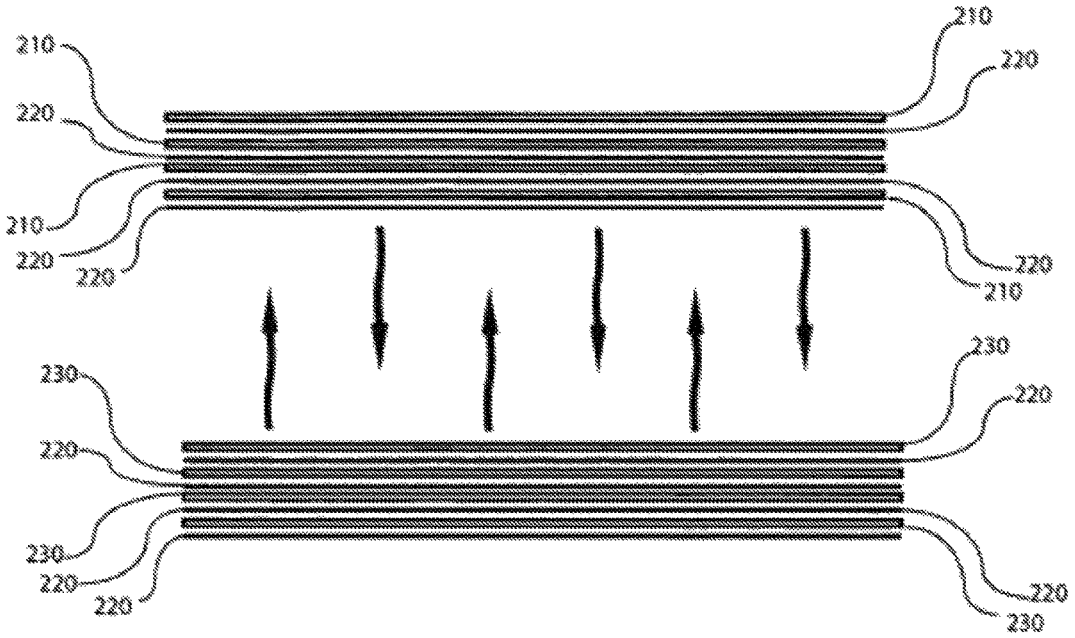
FIG. 5*a* is a lateral view showing the individual layers forming a fragmentation layer.
Figure 5B:
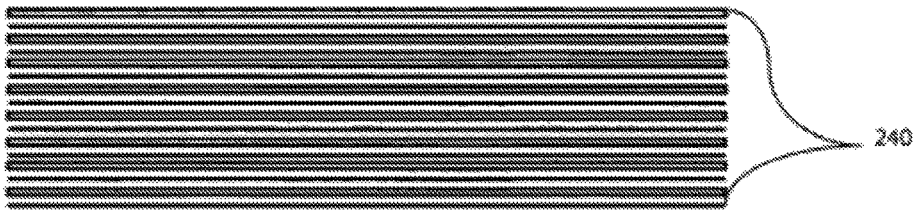
FIG. 5*b* is a lateral view showing a completed fragmentation layer for use in the invention.

FIGS. 5*a* and 5*b* illustrate composite side views of an alternate textile backing comprised of 100% aramid fabrics, pre impregnated with silicone elastomer rubber or similar flexible resins or agents that secure the layers together, but do not impede the fabrics from elasting to their full tensile strength. There are many configurations that can work using this method, but the one illustrated is comprised of two of the top aramid fibers for fragmentation, and one of which, possesses high performance ballistic grade capabilities as well. Since this is a soft ballistic flexible textile system, the intension is that it could be used by itself without combining it with any of the aforementioned tile arrays for defeat of pistol rounds and high velocity frags of varying sizes. The first pack is comprised of at least one ply of KEVLAR® 1420 denier fabric 210 impregnated with curable silicon rubber 220 of at least 1 mil on a side or on both sides, and is stacked to make up about 50% of the weight of the soft textile package. The next pack is a comprised of at least one ply of KEVLAR® KM2+600 denier fabric 230 again impregnated with a curable silicon rubber 220 of at least 1 mm on a side or either side. The various silicon elastomer impregnated aramid layers 210 are stacked consistent with achieving the desired threat protection with the KEVLAR® 1420 denier 210 as the intended strike face and the KM2+600 denier 230 as the wearers side into one package, and then all the layers are pressed and heated to cure the silicone rubber and to compress the layers together into a solid flexible composite 240. Once cured the textile package can be cut to size, and can either be placed behind the aforementioned tile arrays as the fragment catch for the remains of rifle rounds that pass through the tile array(s), or these soft textile packs can be used to make a fragmentation liner for vehicles, aircraft, buildings, or body armor. This embodiment is particularly effective against broken tungsten penetrators and the most likely solution for placement behind the aforementioned tile array panel(s) designed for NIJ level 4 as opposed to level 3 projectiles.

Figure 6:
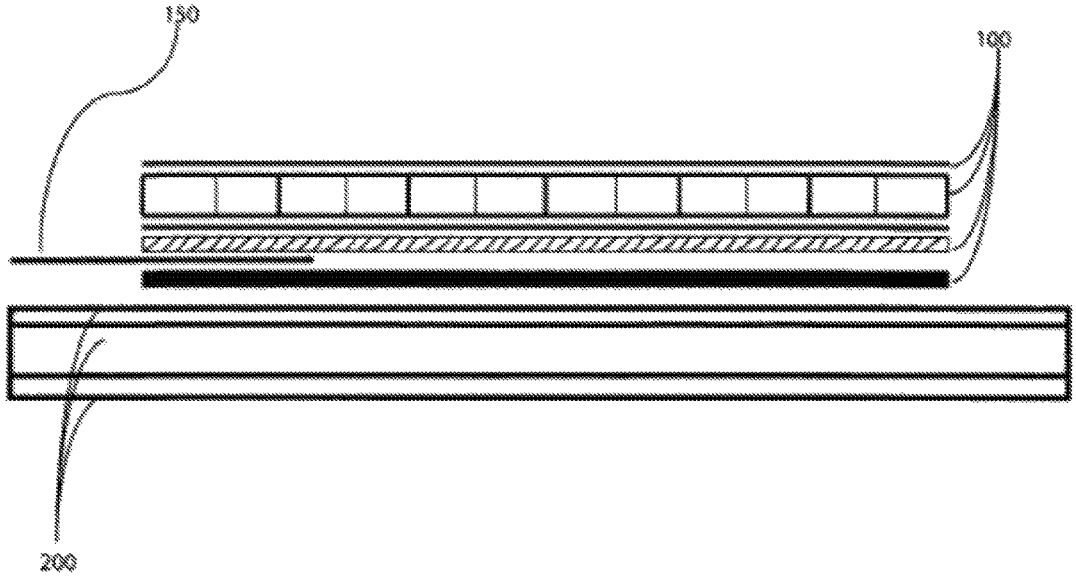
FIG. 6 is a lateral view showing another embodiment of the invention.

FIG. 6 illustrates two examples of how the various parts of the system described above are comprised to complete the rifle defeating system. The first finished tile array 100, which is the strike face of the system is applied to the finished textile pack 200, either by stitching tabs 150 extending from inside the finished tile array 200 or by placement of at least one adhesive coated strap(s) 110 in the horizontal and/or vertical direction and wrapping the strap(s) 155 around the body of the armor panel arrays and substrates 100 and 200. Typically stitching is performed to tack the finished tile array 100 to the finished textile pack 200 when the systems is integrated or standalone meeting the threat as a complete unit, or is strapped with adhesive coated strap(s) as mentioned above and then placed in a separate protective cover and used to upgrade a soft armor system as an "in conjunction with" upgrade creating an scalable modular system that can be upgraded or scaled down as desired by the wearer. Additionally, it is possible to just press the tile arrays and substrates together, and use a pressed and cured unit ready to be housed in a protective cover eliminating tabs, straps, or stitching to complete the finished panel(s). The methods above are examples of typical embodiments and should not limit the contemplations of final use of the inventions described above.

Figure 7:
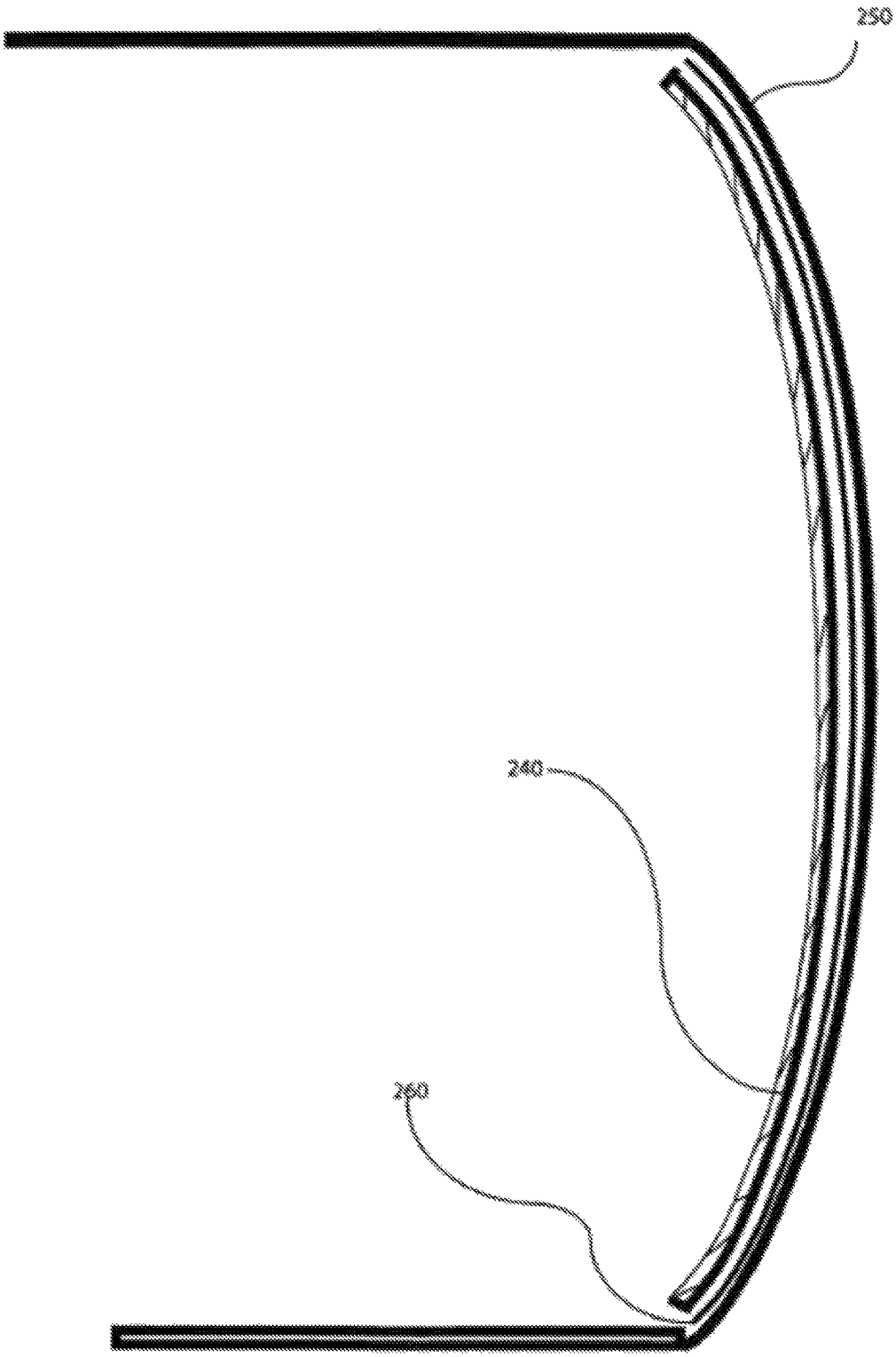
FIG. 7 shows an armor assembly of the invention being adhered to a structure.

FIG. 7 shows the final tile array "strike face" and the final textile package and tile pack array now 240 coupled with an adhesive film against the interior of a structure, as an example an airplane fuselage 250 using an adhesive film and release paper 260. In this example the release film has been removed prior to adhering the armor panel 240 to the fuselage 250. There is no need to press to shape as long as the parts are the right two dimensional size, the flexible nature of the panels allows easy install. This method is an instant invention described as "peel and stick" high threat flexible rifle and/or fragmentation armor.

Figure 8:
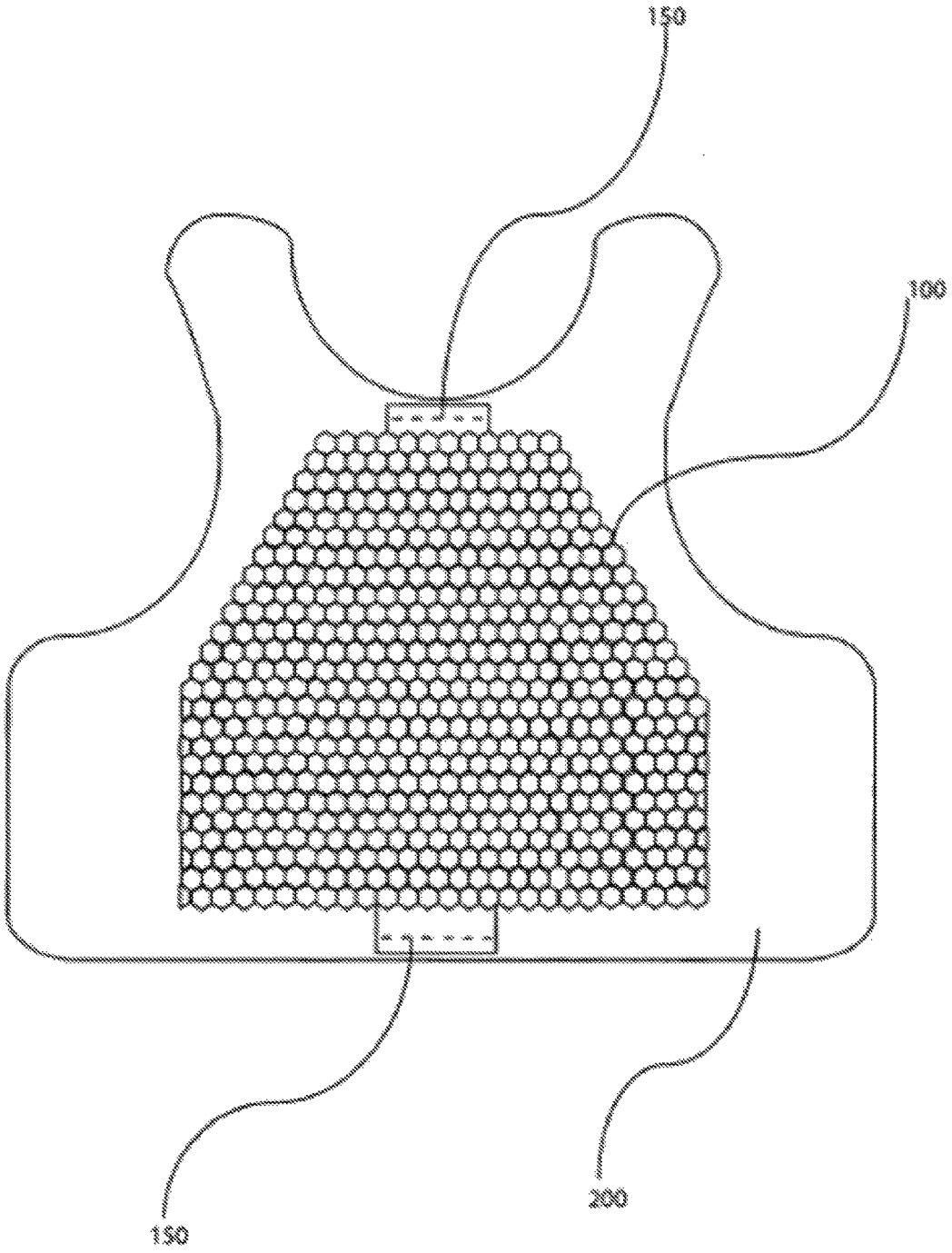
FIG. 8 shows the flexible armor assembly in use as body armor.

FIG. 8 shows a top view of an exampled front panel of body armor with the finished tile array 100 tack stitched through tabs 150, and also through the finished textile package 200 illustrating an integrated system where the rifle defeating area is smaller than the textile package 200, and the whole complete composite is housed in one protective cover prior to be inserted into a carrier system for suspension around the body. The "in conjunction with" method would involve placement of the finished tile array 100 into a separate protective cover, and then into a separate pocket as the strike face in front of textile pack 200 which is also inserted into a typical tactical carrier or concealable carrier. The flexible rifle defeating areas only exist within the perimeter of the tile array 100 "in conjunction with" pack 200. Areas of the textile pack 200 that do not have coverage of the tile array composite 100 are only effective against fragmentation and small arms pistol threats.

The invention claimed is:

1. A flexible armor assembly comprising:

a) a flexible tile array having a plurality of tiles, each said tile being constructed of a high hardness material and having a predetermined shape and size, a specified width and thickness and further having a width to thickness ratio of less than 4.6:1, said plurality of tiles touching side to side, said flexible tile array having a predetermined configuration, a first surface and a second surface;

b) a first high strength fabric adhered to and being coextensive with said first surface of said flexible tile array;

c) a second high strength fabric adhered to and being coextensive with said second surface of said flexible tile array;

d) a flexible depressible shock absorbing substrate being coextensive with said second high strength fabric, and e) a high strength textile fragmentation catch layer being coextensive with said flexible depressible shock absorbing substrate, whereby said flexible tile array forms intersecting seams in said flexible armor assembly to thereby provide a flexible and conforming rifle resistant armor structure having three degrees of freedom when worn by an individual or for adherence to a formed structure.

2. The flexible armor assembly of claim 1, wherein said tiles of said tile array are formed of a ceramic material comprised of silicon carbide or of boron carbide.

3. The flexible armor assembly of claim 1, wherein said tiles of said tile array are formed of a ceramic material comprised of nano-composites.

4. The flexible armor assembly of claim 1, wherein said tiles of said tile array are formed of a ferrous or a non-ferrous metal alloy.

5. The flexible armor assembly of claim 1, wherein said tile shape is a shape selected from the group of shapes consisting of a hexagon, a triangle and a square.

6. The flexible armor assembly of claim 1, wherein said first and second adhesive coated high strength fabric is comprised of an aramid fabric coated with a high temperature resistant acrylic adhesive.

7. The flexible armor assembly of claim 1, wherein said depressible shock absorbing substrate is comprised of at least one layer of a silicone rubber impregnated aramid fabric or of at least one layer of high density foam of at least 1 mm in thickness.

8. The flexible armor assembly of claim 1, wherein said depressible shock absorbing substrate is comprised of at least one layer of a shear thickening polymer of at least 1 mm in thickness or of at least 3 mm thick honeycomb pattern thermal plastic polyurethane.

9. The flexible armor assembly of claim 1, wherein said high strength textile fragmentation catch layer is comprised of UHMW polyethylene cross plied unidirectional flexible laminates or of a combination of aramid fabric and UHMW polyethylene cross plied unidirectional flexible laminates.

10. The flexible armor assembly of claim 1, wherein said high strength textile fragmentation catch layer is comprised of a combination of pressed and cured silicon resin impregnated aramid fabrics.

11. The flexible armor assembly of claim 1, wherein said assembly has an adhesive coated layer and release film on the strike face for application as a "peel and stick flexible rifle defeating armor" for application to a structure, vehicle, or aircraft.

12. A flexible armor assembly comprising:

a) a first flexible tile array having a plurality of first tiles, each said first tile being constructed of a high hardness material and having a predetermined shape and size, a specified width and thickness and further having a width to thickness ratio of more than 4.6:1, said plurality of first tiles touching side to side, said flexible first tile array having a predetermined configuration, a first surface and a second surface;

b) a first high strength fabric adhered to and being coextensive with said first surface of said first flexible tile array, c) a second high strength fabric adhered to and being coextensive with said second surface of said first flexible tile array, d) a flexible depressible shock absorbing substrate being coextensive with said second high strength fabric of said first flexible tile array, e) a second flexible tile array having a plurality of second tiles, each said second tile being constructed of a high hardness material and having a predetermined shape and size, a specified width and thickness and further having a width to thickness ratio of less than 4.6:1, said plurality of second tiles touching side to side, said second flexible tile array having a predetermined configuration, a first surface and a second surface;

f) at least one third high strength fabric layer adhered to and being coextensive with said first surface of said second flexible tile array, g) at least one fourth high strength fabric layer adhered to and being coextensive with said second surface of said second flexible tile array, and h) a high strength textile fragmentation catch layer being coextensive with said at least one fourth high strength fabric layer of said second flexible tile array, whereby said first and second flexible tile arrays form intersecting seams in said flexible armor assembly to thereby provide a flexible and conforming armor structure having three degrees of freedom when worn by an individual or for adherence to a formed structure.

13. The flexible armor assembly of claim 12, wherein said tiles of said first and second flexible tile arrays are formed of a material selected from the group of materials consisting of a ceramic material comprised of silicon carbide, boron carbide and nano-composites, a ferrous metal alloy and a non-ferrous metal alloy.

14. The flexible armor assembly of claim 12, wherein said first and second tile shapes are selected from the group of shapes consisting of a hexagon, a triangle and a square.

15. The flexible armor assembly of claim 12, wherein said first, second, third and fourth adhesive coated high strength fabrics are comprised of an aramid fabric coated with a high temperature resistant acrylic adhesive.

16. The flexible armor assembly of claim 12, wherein said depressible shock absorbing substrate is comprised of at least one layer of a silicone rubber impregnated aramid fabric or of at least one layer of high density foam of at least 1 mm in thickness.

17. The flexible armor assembly of claim 12, wherein said depressible shock absorbing substrate is comprised of at least one layer of a shear thickening polymer of at least 1 mm in thickness or of at least 3 mm thick honeycomb pattern thermal plastic polyurethane.

18. The flexible armor assembly of claim 12, wherein said high strength textile fragmentation catch layer is comprised of a combination of pressed and cured silicon resin impregnated aramid fabrics.

19. The flexible armor assembly of claim 12, wherein said assembly has an adhesive coated layer and release film on the strike face for application as a "peel and stick flexible rifle defeating armor" for application to a structure, vehicle, or aircraft.

20. A flexible armor assembly meeting the standards of NIJ0101.03 comprising:

a) a flexible tile array having a plurality of tiles, each said tile being constructed of a high hardness material and having a predetermined shape and size, a specified width and thickness and further having a width to thickness ratio of less than 4.6:1, said plurality of tiles touching side to side, said flexible tile array having a predetermined configuration, a first surface and a second surface, said flexible tile array forming intersecting seams in said flexible armor assembly;

b) a first flexible high strength fabric adhered to and being coextensive with said first surface of said flexible tile array;

c) a second flexible high strength fabric adhered to and being coextensive with said second surface of said flexible tile array;

d) a flexible depressible shock absorbing substrate being coextensive with said second high strength fabric; and e) a high strength textile fragmentation catch layer being coextensive with said flexible depressible shock absorbing substrate, providing a flexible and body conforming rifle resistant armor structure when worn by an individual or when adhered to a formed structure.

* * * * *